US005192462A

United States Patent [19]

Gloor et al.

[11] Patent Number: 5,192,462

[45] Date of Patent: Mar. 9, 1993

[54] THICKENING AGENTS FOR TOPICAL PREPARATIONS

[75] Inventors: Guy J. Gloor, Tinton Falls; Kevin F. Gallagher, Middletown; Abel G. Pereira, Belleville, all of N.J.

[73] Assignee: Croda Inc., New York, N.Y.

[21] Appl. No.: 920,011

[22] Filed: Jul. 27, 1992

Related U.S. Application Data

[63] Continuation of Ser. No. 326,298, Mar. 21, 1989, abandoned.

[51] Int. Cl.[5] ..... C11D 3/37; C11D 1/90

[52] U.S. Cl. ..... 252/174.21; 252/174.22; 252/174.23; 252/DIG. 13; 252/DIG. 14; 554/227; 560/263

[58] Field of Search ..... 252/174.21, 174.22, 252/174.23, DIG. 13, DIG. 14; 554/227; 560/263

[56] References Cited

U.S. PATENT DOCUMENTS

| | | | |
|---|---|---|---|
| 2,192,907 | 3/1940 | Harris | 252/356 |
| 2,307,047 | 1/1943 | Katzmann et al. | 252/174.21 |
| 2,381,247 | 8/1945 | Barth et al. | 252/56 S |
| 2,441,555 | 5/1948 | Barth et al. | 260/410.6 |
| 2,500,349 | 3/1950 | De Groote et al. | 260/410.6 |
| 2,528,378 | 10/1950 | Mannheimer | 252/546 |
| 2,781,354 | 2/1957 | Mannheimer | 252/546 |
| 3,435,024 | 3/1969 | Nobile et al. | 252/174.18 |
| 3,776,857 | 12/1973 | Lindner et al. | 252/356 |
| 3,954,658 | 5/1976 | Tsutsumi et al. | 252/312 |
| 3,958,581 | 5/1976 | Abegg et al. | 132/7 |
| 3,964,500 | 6/1976 | Drakoff | 132/7 |
| 3,990,991 | 11/1976 | Gerstein | 252/542 |
| 4,009,256 | 2/1977 | Nowak, Jr. et al. | 424/70 |
| 4,048,301 | 9/1977 | Papantoniou | 424/70 |
| 4,080,310 | 3/1978 | Ng et al. | 252/544 |
| 4,097,403 | 6/1978 | Tsutsumi et al. | 252/312 |
| 4,209,333 | 6/1980 | Ong et al. | 252/356 |
| 4,239,641 | 12/1980 | Perner et al. | 252/142 |
| 4,261,851 | 4/1981 | Duke | 252/174.21 |
| 4,364,837 | 12/1982 | Pader | 252/173 |
| 4,450,090 | 5/1984 | Kinney | 252/106 |
| 4,488,982 | 12/1984 | Cuscurida et al. | 252/174.21 |
| 4,614,622 | 9/1986 | Hueltinger et al. | 260/410.7 |
| 4,741,855 | 5/1988 | Grote et al. | 252/142 |
| 4,774,016 | 9/1988 | Gazzani | 252/170 |
| 4,774,017 | 9/1988 | Seibert et al. | 252/174.12 |
| 4,803,010 | 2/1989 | Ogino et al. | 252/174.21 |

OTHER PUBLICATIONS

Research Disclosure, May, 1979, (C. D. Barnsbee) 18120, p. 221.

CA RN#72142-52-0.

CA RN#75181-93-0.

Anon., *Res. Discl.*, 195, 283 (1980).

Anon, *Res. Discl.*, 197, 394 (1980).

Halloran, *Soaps/Cosm./Chem.*, 22-6 (Mar., 1992).

Crudden, "Applications of N-Acyl Sarcosine Surfactants," *Indust. Applic. of Surfact. III Conf.*, (Royal Society of Chemistry, London 1992).

*Primary Examiner*—A. Lionel Clingman

*Assistant Examiner*—Kery A. Fries

*Attorney, Agent, or Firm*—Lerner, David, Littenberg, Krumholz & Mentlik

[57] ABSTRACT

A thickening agent based upon a polyether ester compound having the formula:

Wherein:

$R_1$ is H or $R_2$ is a hydrocarbon chain having greater than 5 carbon atoms; and (W+X+Y+Z) is greater than 60.

The thickening agents are useful in formulating various topical preparations, for example, shampoos, sunscreen lotions, cosmetics and the like.

12 Claims, 4 Drawing Sheets

THICKENING AGENTS FOR TOPICAL PREPARATIONS

This is a continuation of Ser. No. 326,298 filed Mar. 21, 1989 , now abandoned.

BACKGROUND OF THE INVENTION

The present invention relates in general to thickening agents based upon polyether esters, and more particularly, to topical preparations prepared therefrom.

Thickening agents are used for the thickening of natural and synthetic oils, aqueous electrolyte solutions, and aqueous solutions of organic substances. Their use facilitates the handling of liquids used as household chemicals. Thickening agents are also customarily used in electrolyte solutions, which are required in batteries. Heretofore, waxes, carboxyalkyl celluloses, starch, xanthan gum, or high-molecular esters have been used as thickening agents.

It is customary to use thickening agents for cosmetic, detergent-containing preparations, e.g., shampoos, so as to stabilize the disperse systems and for better handling during use. In the case of ether sulfates, it is customary to thicken the preparations with inorganic electrolytes, preferably with common salt. In the case of other detergents, use is, for example, made of distearyl polyglycolester, cellulose derivatives, or natural and synthetic soluble polymers. The preparations obtained in this manner exhibit a behavior that is structurally viscous and/or thixotropic.

The formulation of shampoos necessitates a trade off between two conflicting physical properties. On the one hand, consumer conception demands a higher viscosity product, while on the other hand, economics require a product low in solid content. Typically, today's shampoos have a solid content in the range of 6 to 18 percent. Long chain polyethers containing a fatty moiety at one or both ends of the ether chain have been used as viscosity modifying agents in surfactant systems in the formulation of shampoo compositions. Specific viscosity modifying agents used in shampoo compositions have included PPG-5-Ceteth-20, and particularly, PEG 150 Distearate (aka. PEG 6000 Distearate), available from Witco. These agents distinguish themselves from other classes of cosmetic thickening agents by their low reactivity, low toxicity and usefulness over a broad pH range. These thickening agents are, however, linear in secondary structure and are able to fold over upon themselves thereby limiting their tendency to behave in a manner characteristic of long chain polymers. In addition, PEG 6000 Distearate is difficult to manufacture, often forming molecules having a different structure from batch to batch, i.e., containing free stearic acid, distearates and monostearates.

In Seibert et al., U.S. Pat. No. 4,774,017 there is disclosed a thickening agent comprising polyether compounds of the formula:

$$R_1O(CH_2CH_2O)_n(CH_2\overset{\overset{\displaystyle CH_3}{|}}{C}H-O)_m(CH_2\overset{\overset{\displaystyle R_2}{|}}{C}H-O)_pH$$

These polyether derivatives are prepared by the addition of long chain 1,2-epoxy compounds having a chain length of 10 to 32 carbon atoms to either a polyethylene glycol monoether having an average molecular weight of 800 to 5,000 (the monoether group has a substituted or unsubstituted hydrocarbon radical having at least 10 carbon atoms), or to a polyethylene glycol-polypropylene glycol monoether with an average molecular weight of 850 to 6,300 (having repeating ethylene oxide and propylene oxide units each forming a polyethylene glycol and polypropylene glycol block) in which the monoether group forms the end of the polyethylene glycol block.

In Perner et al., U.S. Pat. No. 4,239,641, there is disclosed a method for regulating the viscosity of aqueous slurries of detergents and cleansers by adding to the slurries viscosity regulators, such as dihydric, trihydric or tetrahydric aliphatic alcohols, monobasic aliphatic carboxylic acids, hydroxycarboxylic acids, esters of the same alcohols, and the same acids or compounds in which the alcohols, carboxyl gases, hydroxycarboxyl acids and the individual components of the esters are from 5 to 9 carbon atoms, one of which is a quaternary carbon atom. The alcohols and hydroxycarboxylic acids contain exclusively primary alcohol groups and the carboxylic acids and the hydroxycylic acids have the carboxyl group bonded to the quaternary carbon atom.

In Gazzani et al., U.S. Pat. No. 4,774,016, there is disclosed aqueous preparations for the cleaning of skin, scalp and hair. The emulsifying agent used is selected from the group polyoxyethylenethers of higher alcohols having 10 to 40 and preferably 15 to 25 oxyethylene groups. Examples of suitable higher alcohols preferably containing 12 to 18 carbon atoms comprises lauryl, myristyl cetyl, stearyl, oleyl alcohols and cholesterol. An example of this preparation includes 1% carboxymethylcellulose, 9% polyoxyethylate ricinoleic glyceride 40, 1.5% polyoxyethylene cholesterol 24, and water. In other preparations, polyoxyethylene lauryether, polyoxyethylene sorbitan monolaurate, and polyethylene glycol 100 are used.

In Cuscurida et al., U.S. Pat. No. 4,488,982, there is disclosed low foaming, non-ionic polyether polycarbonate surfactants. Specifically disclosed is the preparation of monohydric polyether polycarbonate materials by reacting a monofunctional initiator with an alkaline carbonate or with an alkaline oxide and carbon dioxide to form polyether polycarbonate materials.

In Pader, U.S. Pat. No. 4,364,837, there is disclosed shampoo compositions including a water-miscible saccharide, water, a non-ionic or cationic hair grooming agent, and an anionic detergent. The hair grooming agents include cationic polyamide polymers such as low molecular weight adipic acid/diethylenetrimiamine polyamides and the copolymers of vinylpyrrolidone and dimethylaminoethyl methacrylate quaternized with diethyl sulfate as described in U.S. Pat. No. 4,080,310, the graphed cationic copolymer containing N-vinylpyrrolidone, dimethylaminoethyl methacrylate and polyethylene glycol described in U.S. Pat. No. 4,048,301, the mineral acid salts of the amino-alkyl esters of homo- and copolymers of unsaturated carboxylic acids having from 3 to 5 carbon atoms described in U.S. Pat. No. 4,009,256, the long-chain polymeric quaternary ammonium salts described in U.S. Pat. No. 3,990,991, the quaternary nitrogen-containing cellulose ethers described in U.S. Pat. No. 3,962,418 and the copolymers and etherified cellulose and starch described in U.S. Pat. No. 3,958,581.

Anionic detergents used include sodium lauryl sulfate, sodium oleyl succinate, ammonium lauryl sulfosuccinate, sodium lauryl ether sulfate, ammonium lauryl sulfate, sodium dodecylbenzene sulfinate, triethanolamine dodecylbenzene sulfinate, and sodium N-lauryl sarcosinate. The amphoteric or amphoyltic detergents include N-lauryl-N,carboxymethyl-N-(2-hydroxyethyl) ethylenediamine, cocobetaine, and the Miranol compounds in U.S. Pat. Nos. 2,528,378 and 2,781,354. Other amphoteric detergents include quaternary cycloimidates, betaines, and sultaines disclosed in U.S. Pat. No. 3,964,500. Preferred thickeners are carboxymethyl cellulose, methyl cellulose, hydroxypropyl cellulose, Carbopols (Goodrich Company), vegetable gums, alginates and derivatives and latexes. In addition, amides may be used to obtain specific foam characteristics and to thicken the shampoo. Suitable amides include coconut fatty acids, diethanolamides, lauric isopropanolamides and others.

In Grote, U.S. Pat. No. 4,741,855, there is disclosed a shampoo composition comprising synthetic surfactants selected from the group of anionic surfactants, zwitterionic surfactants, amphoteric surfactants and mixtures thereof, insoluble non-volatile silicone, a long-chain ($C_{16}$ to $C_{22}$) acyl derivative or a long-chain ($C_{16}$ to $C_{22}$) amine oxide selected from the group consisting of ethylene glycol, long-chain esters, alkanol amides of long-chain fatty acids, long-chain esters of long-chain fatty acids, glyceryl long-chain esters, long-chain esters of long-chain alkanolamides, long-chain alkyl dimethyl amine oxides, mixtures thereof, and water.

In Hott et al., German Patent Application No. DE 37 26015 Al, there is disclosed reversible heat sensitive recording materials. Some of the compounds disclosed herein include pentaerythritol monostearate 78-42-2, pentaerythritol tetrastearate 115-86-6, petnaerythritol monolaurate 13057-50-6, pentaerythritol tetralaurate 13081-97-5, pentaerythritol distearate 14117-96-5, pentaerythritol monopalmitate 17661-50-6, pentaerythritol tetrapalmmitate 20753-89-3, pentaerythritol dilaurate 25354-61-4, pentaerythritol dipalmitate 26040-98-2, pentaerythritol tristearate 28553-12-0, pentaerythritol trilaurate 68258-72-0, and pentaerythritol dibehenate 68818-69-9.

In Maeda et al., Japanese Patent Application No. JP 61/207358 A2, there is disclosed esterification of alcohols with carboxylic acids in the presence of metal chloride and alkali, e.g., KOH, NaOH, $K_2CO_3$, $Na_2CO_3$, gave light colored and chlorine-free esters with good stability towards oxidation, being useful as plasticizers, lubricants and surfactants. A 1:4.20 mixture of pentaerythritol and caproic acid containing 0.1 molecular percent KOH and 0.1 molecular percent $SnCl_2$ to the acid was heated to give tetra-O-caproylpentaerythritol. Also disclosed are caproic acid reactions with esterification reactions of pentaerythritol and glycerine reactions with trimethylolpropane, pentaerythritol, and neopentylglycol.

Accordingly, there is an unsolved need for a new class of thickening agents based upon polyether esters which have low reactivity, low toxicity and which are useful over a broad pH range.

SUMMARY OF THE INVENTION

It is broadly an object of the present invention to provide thickening agents in the nature of esters of very high molecular weight polyethers having four polyether chains covalently bonded to one central carbon atom.

Another object of the present invention is to provide a class of thickening agents adaptable for use in formulating topical preparations and the like.

In accordance with one embodiment of the present invention, there is provided a polyether ester compound of the formula:

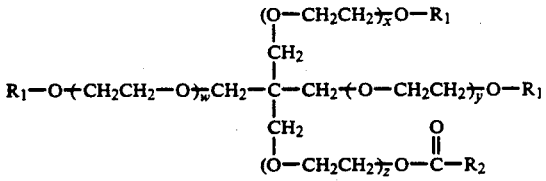

wherein:

$R_1$ is H or

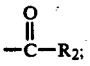

$R_2$ is a hydrocarbon chain having greater than 5 carbon atoms; and $(W+X+Y+Z)$ is greater than 60.

In accordance with another embodiment of the present invention, there is provided a shampoo composition including a detergent, water and a thickening agent comprising a polyether ester compound of the formula:

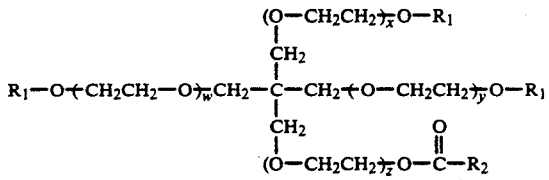

Wherein:

$R_1$ is H or

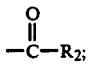

$R_2$ is a hydrocarbon chain having greater than 5 carbon atoms; and $(W+X+Y+Z)$ is greater than 60.

In accordance with another embodiment of the present invention, there is provided a composition for topical application including an active ingredient, water and a thickening agent comprising a polyether ester compound of the formula:

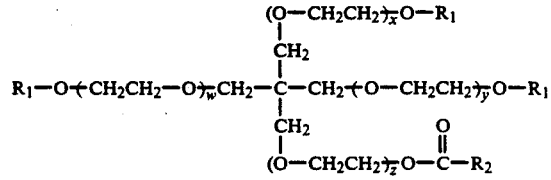

Wherein:

$R_1$ is H or $$-\overset{\overset{\displaystyle O}{\|}}{C}-R_2;$$

$R_2$ is a hydrocarbon chain having greater than 5 carbon atoms; and $(W+X+Y+Z)$ is greater than 60.

BRIEF DESCRIPTION OF THE DRAWINGS

The above description, as well as further objects, features and advantages of the present invention will be more fully understood with reference to the following detailed description of a presently preferred, but nonetheless illustrative, thickening agents for topical preparations, when taken in conjunction with the accompanying drawings, wherein.

DETAILED DESCRIPTION

Figure 1:
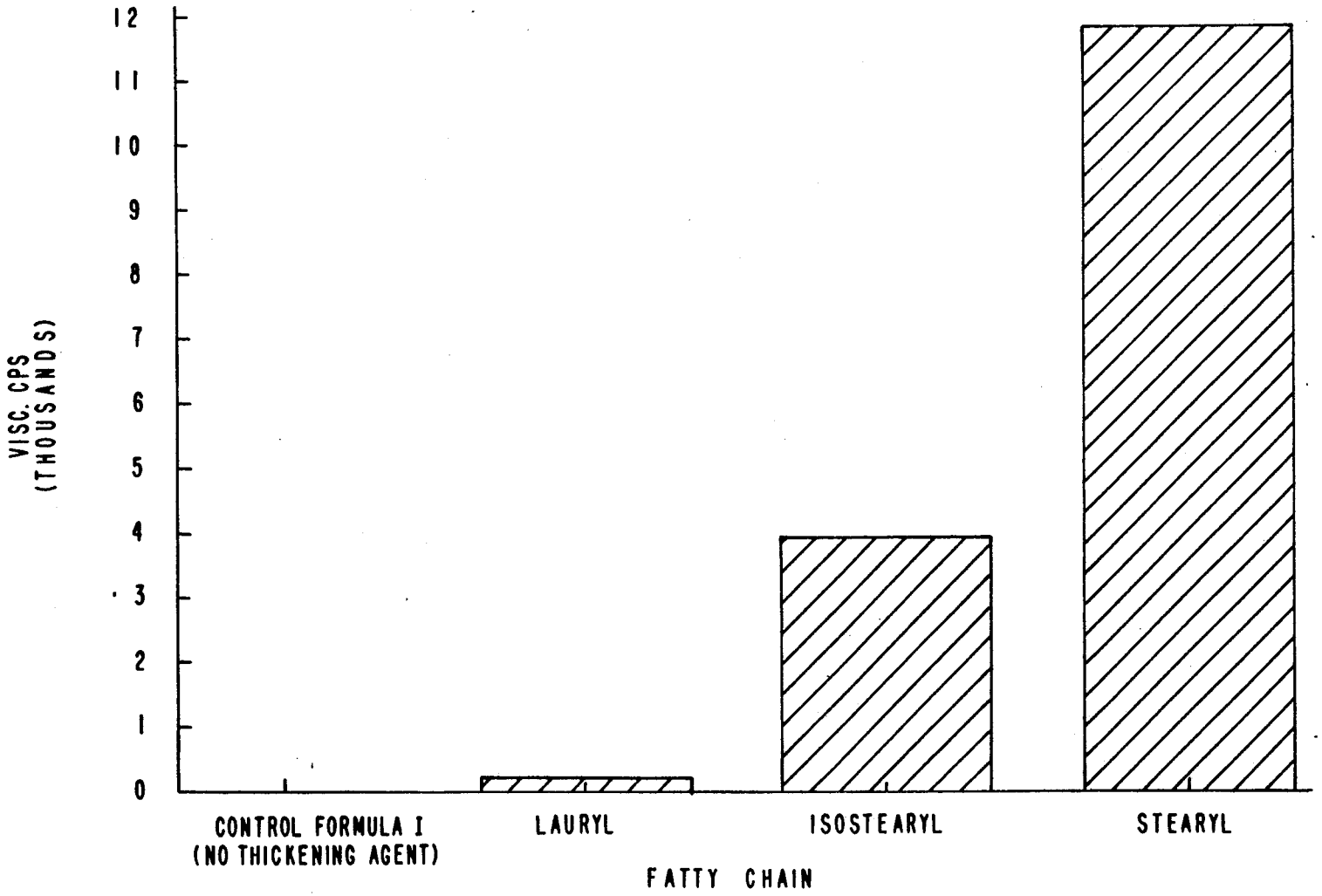
FIG. 1 is a graph illustrating the comparative efficiencies in viscosity enhancement by the incorporation of PEG 150 pentaerythritol tetralaurate, PEG 150 pentaerythritol tetraisosterate and PEG 150 pentaerythritol tetrasterate in a first control sample.

The thickening agents of the present invention are based upon polyether ester compounds of the formula:

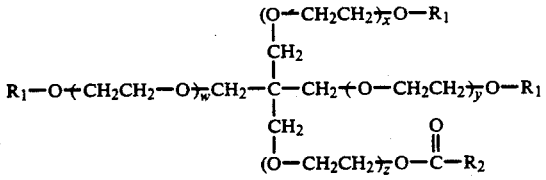

Wherein:

$R_1$ is H or $$-\overset{\overset{\displaystyle O}{\|}}{C}-R_2;$$

$R_2$ is a hydrocarbon chain having greater than 5 carbon atoms; and $(W+X+Y+Z)$ is greater than 60.

The hydrocarbon chain may be either straight or branched, having 0 to 6 double bonds, and preferably having 6 to 26 carbon atoms. More preferably, the preferred range of the hydrocarbon chain is from about 12 to 22 carbon atoms, and most preferably 18 carbon atoms. The preferred range for the term $(W+X+Y+Z)$ is in the range from about 100 to 175, and most preferably 150. Particularly useful thickening agents in accordance with the present invention include PEG 105 pentaerythritol dibehenate, PEG 105 pentaerythritol tetrabehenate, PEG 150 pentaerythritol tetrastearate, PEG 150 pentaerythritol tetralaurate, PEG 150 pentaerythritol tetraisostearate, PEG 130 pentaerythritol tetrastearate and PEG 75 pentaerythritol tetrastearate. Also contemplated as particularly useful thickening agents in accordance with the present invention are PEG 105 pentaerythritol monobehenate, PEG 05 pentaerythritol tribehenate, PEG 150 pentaerythritol monostearate, PEG 150 pentaerythritol distearate, PEG 50 pentaerythritol tristearate, PEG 150 pentaerythritol monolaurate, PEG 150 pentaerythritol dilaurate, PEG 150 trilaurate, PEG 150 monoisostearate, PEG 150 pentaerythritol diisostearate, PEG 150 pentaerythritol triisostearate, PEG 130 pentaerythritol monostearate, PEG 130 pentaerythritol distearate, PEG 130 pentaerythritol tristearate, PEG 75 pentaerythritol monostearate, PEG 75 pentaerythritol distearate, and PEG 75 pentaerythritol tristearate.

The thickening agents of the present invention may be employed in the formulation of a number of topical preparations, for example, shampoos, eye make-up formulations, cream rinses, lipsticks, lotions, sun screens, gels, cosmetics in general, household cleaning agents, cosmetic emulsions or cosmetic gels, hair dressing preparations, foam baths and the like. The thickening agents of the present invention are applicable to the formulation of a variety of topical preparations as noted hereinabove as falling within the scope of the present invention.

The thickening agents of the present invention are prepared from a pentaerythritol intermediate such as PEG 75 pentaerythritol, PEG 105 pentaerythritol, PEG 130 pentaerythritol, PEG 150 pentaerythritol and the like. PEG stands for polyethylene glycol, while the number thereafter stands for the number of moles of ethylene glycol attached to the molecule. These intermediates are formed as a reaction product of pentaerythritol and ethylene oxide. By controlling the reaction, the number of moles of ethylene glycol attached to the molecule may be determined as desired.

However, as pentaerythritol is a solid having a melting point of about 267° C., it is initially reacted with ethylene carbonate which functions as both a solvent and a reactant to provide a liquid intermediate, PEG 4 pentaerythritol. This intermediate is subsequently reacted with ethylene oxide to produce the desired PEG "X" pentaerythritol intermediate having the desired number of moles "X" of ethylene glycol adhering to the molecule. It is to be understood that the number of moles of ethylene glycol in the specific examples is by way of illustration only, and is not intended as a limitation upon the thickening agent and topical preparations formulated therefrom which constitute the present invention.

The following examples while not intended to be limiting, demonstrate several preferred embodiments of formulating a PEG "X" pentaerythritol intermediate in accordance with the present invention.

EXAMPLE 1

Preparation of PEG 4 Pentaerythritol

To a 2000 ml, 4 neck, round bottom flask, was charged 204.2 g. (1.50 mol) pentaerythritol (technical grade, Hoechst Celanese), 541.2 g. (6.15 mol) ethylene carbonate (Texaco), 2.3 g. Potassium carbonate, and 0.1 g Hypophosphorus acid (50% sol'n). The material was heated slowly to 135° C. with a constant nitrogen sparge. At 135° C. the material began to show signs of effervescence and the nitrogen was throttled back and the heating rate increased. At 143° C. all the pentaerythritol had dissolved, the nitrogen had been turned off and a rotameter fitted to the apparatus gas vent. At this point the evolved Carbon dioxide (confirmed with Barium carbonate solution rate was approximately 500 ml/min.

Approximately 50 minutes after the initiation of the reaction, the temperature had reached 168° C. and the $CO_2$ rate had reached 1 liter/min. the heat was reduced to maintain a temperature of 170° C. These conditions were maintained for 3 hours at which time the $CO_2$ rate began to tail off and the sparge of nitrogen was restarted. The temperature was raised to 180° C. and maintained for another hour, after which the material was cooled to 78° C. and filtered. The material collected, in approximately theoretical yield, was a light yellow viscous liquid having a hydroxyl value of 87.5 implying an average molecular weight of 326.6.

EXAMPLE 2

Preparation of PEG 22 Pentaerythritol

To a 2 liter parr stirred pressure vessel fitted with vacuum, nitrogen, pressurized ethylene oxide feed, heat and cooling, was charged 268.3 g (.858 mol) PEG 4 pentaerythritol, 0.5–10 grams of an alkyli metal hydroxide as a catalyst, e.g., potassium hydroxide or sodium hydroxide, and 0.1 g. sodium borohydride. The reactor was sealed, flushed 3 times with Nitrogen and heated under vacuum. At 140° C. the heating was stopped, the pressure adjusted to 0 psig with $N_2$, and ethylene oxide addition started. The temperature was maintained at 140°–145° C. with cooling as needed and the pressure at 38 psig by the ethylene oxide feed rate. These conditions were maintained until 831.7 g. (18.88 mol) of ethylene oxide were added, at which time the ethylene oxide feed was shut off and the material allowed to react for another half hour at 145° C.

The reactor was the vented and cooled and the catalyst neutralized with $H_3PO_4$ to a pH of 7, yielding 1100 g. (yield 99+%) light yellow viscous liquid.

EXAMPLE 3

Preparation of PEG 105 Pentaerythritol

To a 2 liter parr stirred pressure vessel fitted with vacuum, nitrogen, pressurized ethylene oxide feed, heat and cooling, was charged 285.0 g. (0.222 mol) PEG 22 pentaerythritol, 0.5–10 grams of an alkyli metal hydroxide as a catalyst, e.g., potassium hydroxide or sodium hydroxide, and 0.1 g. sodium borohydride. The reactor was sealed, flushed 3 times with nitrogen and heated under vacuum. At 140° C. the heating was stopped, the pressure adjusted to 0 psig with $N_2$, and ethylene oxide addition started. The temperature was maintained at 140°–145° C. with cooling as needed and the pressure at 38 psig by the ethylene oxide feed rate. These conditions were maintained until 815.0 g. (18.50 mol) of ethylene oxide were added, at which time the ethylene oxide feed was shut off and the material allowed to react for another half hour at 145° C.

The reactor was then vented, cooled and the catalyst dried under vacuum for 1 hour and cooled and the catalyst neutralized with $H_3PO_4$ to a pH of 7. This yielded 1070 g. (yield 97.2%) of a viscous yellowish grey liquid which upon standing and cooling became a hard waxy solid. The hydroxyl value was 51.9 implying a molecular weight of 4320.

EXAMPLE 4

Preparation of PEG 150 Pentaerythritol

To a 2 liter parr stirred pressure vessel fitted with vacuum, nitrogen, pressurized ethylene oxide feed, heat and cooling, was charged 691.5 g. (0.140 mol) PEG 105 pentaerythritol (mw=4937.45), 0.5–10 grams of an alkyli metal hydroxide as a catalyst, e.g., potassium hydroxide or sodium hydroxide and g. sodium borohydride. The reactor was sealed, flushed 3 times with nitrogen and heated under vacuum. At 140° C. the heating was stopped, the pressure adjusted to 0 psig with $N_2$, and ethylene oxide addition started. The temperature was maintained at 140°–145° C. with cooling as needed and the pressure at 38 psig by the ethylene oxide feed rate. These conditions were maintained until 815.0 g. (18.50 mol) of ethylene oxide were added, at which time the ethylene oxide feed was shut off and the material allowed to react for another half hour at 145° C. The reactor was then vented, cooled to 115° C., dried under vacuum for 1 hour and cooled and the catalyst neutralized with acetic acid to a pH of 7. This yielded 978 g. (yield 97.8%) of a viscous yellowish grey liquid which upon standing and cooling became a hard waxy solid. The hydroxyl value was 43.4 implying a molecular weight of 5160.

Utilizing certain of the above-formulated intermediates, thickening agents in accordance with the present invention were formulated in accordance with the following examples, which are not intended to be limiting, but rather demonstrating several preferred embodiments of the present invention.

EXAMPLE 5

Preparation of PEG 105 Pentaerythritol Dibehenate

A 1000 ml round bottomed flask was charge with 648.0 g (0.15 mol) PEG 105 pentaerythritol and 99.0 g. (0.30 mol) behenic acid. The mass was heated to 100° C. with a $N_2$ sparge, 0.75 g methane sulfonic acid and 0.1 g hypophosphorus acid were charged. The batch was heated to 165° C. while collecting the water of reaction, and maintained until an acid value of 11.5 was reached. The finished material was a white waxy solid having an acid value of 11.5, and a hydroxyl value of 27.05.

EXAMPLE 6

Preparation of PEG 150 Pentaerythritol Tetrastearate

A 1000 ml round bottomed flask was charged with 619.9 g (0.12 mol) PEG 150 pentaerythritol and 136.3 g (0.48 mol) triple pressed stearic acid. The mass was heated to 100° C. with a $N_2$ sparge, 1.0 g. phosphoric acid and 0.1 g. hypophosphorus acid were charged. The batch was heated to 215° C. while collecting the water of reaction, and maintained until an acid value of 9.9 was reached. The finished material was a white waxy solid having an acid value of 9.9.

EXAMPLE 7

Preparation of PEG 150 Pentaerythritol Tetraisostearate

A 1000 ml round bottomed flask was charged with 619.9 g (0.12 mol) PEG 150 pentaerythritol and 136.3 g (0.48 mol) triple pressed stearic acid. The mass was heated to 100° C. with a $N_2$ sparge, 1.0 g. phosphoric acid and 0.1 g. hypophosphorus acid were charged. The batch was heated to 215° C. while collecting the water of reaction, and maintained until an acid value of 15.3 was reached. The finished material was a yellow waxy solid.

EXAMPLE 8

Preparation of PEG 150 Pentaerythritol Tetralaurate

A 1000 ml round bottomed flask was charged with 619.9 g (0.12 mol) PEG 150 pentaerythritol and 96.0 g (0.48 mol) lauric acid. The mass was heated to 100° C. with a $N_2$ sparge, 1.0 g. phosphoric acid and 0.1 g. hypophosphorus acid were charged. The batch was heated to 215° C. while collecting the water of reaction, and maintained until an acid value of 12.4 was reached. The finished material was a white waxy solid.

EXAMPLE 9

Preparation of PEG 130 Pentaerythritol Tetrastearate

A 1000 ml round bottomed flask was charged with 598.4 g. (0.12 mol) PEG 130 pentaerythritol and 36.3 g. (0.48 mol) triple pressed stearic acid. The mass was heated to 100° C. with a $N_2$ sparge, 1.0 g. phosphoric acid and 0.1 g hypophosphorus acid were charged. The batch was heated to 215° C. while collecting the water of reaction, and maintained until an acid value of 11.5 was reached. The finished material was a grey waxy solid.

EXAMPLE 10

Preparation of PEG 105 Pentaerythritol Tetrabehenate

A 1000 ml round bottomed flask was charged with 648.0 g. (0.15 mol) PEG 105 pentaerythritol and 186 g. (0.60 mol) behenic acid. The mass was heated at 100° C. with a $N_2$ sparge, 0.75 g. methane sulfonic acid and 0.1 g. hypophosphorus acid were charged. The batch was heated to 165° C. while collecting the water of reaction, and maintained until an acid value of 11.5 was reached. The finished material was a white waxy solid having an acid value of 11.5, and a hydroxyl value of 12.

EXAMPLE 11

Preparation of PEG 75 Pentaerythritol Tetrastearate

A 1000 ml round bottomed flask will be charged with 620 g. (0.24 mol) PEG 75 pentaerythritol and 272 g. (0.96 mol) triple pressed stearic acid. The mass will be heated to 100° C. with a $N_2$ sparge, 1.0 g. phosphoric acid and 0.1 g. hypophosphorus acid will be charged. The batch will be heated to 215° C. while collecting the water of reaction, and maintained until an acid value of less than 10.0 is reached. The finished material will be a white waxy solid.

In order to determine the comparative effectiveness of various thickening agents prepared in accordance with the present invention via the above examples, certain thickening agents were incorporated into a shampoo control formulation. Control formula I was formulated by mixing together the following components by weight percentage:

| CONTROL FORMULA I | |
|---|---|
| Miranol cm | 12.5% |
| Sodium laureth sulfate 3 mol | 20.0% |
| Crodesta SL-40 | 5.0% |
| Deionized Water | 62.5% |

Miranol cm is one primary active detergent formulated from cocoamphoacetate. Sodium laureth sulfate is also utilized in the composition as a primary detergent. Crodesta SL-40 is a formulation of sucros monococate included in the composition as a non-ionic surfactant used to reduce the skin irritation properties of the Miranol cm.

PEG 150 pentaerythritol tetralaurate, PEG 150 pentaerythritol tetraisostearate .and PEG 150 pentaerythritol tetrastearate were added to a respective quantity of the Control Formula I in an amount of 1% by weight of the composition upon heating the Control Formula I in a range of from 45°-75° C. The resulting shampoo formulations were cooled to 25° C. to produce a clear solution. The viscosity of the Control Formula I (without thickening agent) was compared with the shampoo formulations incorporating PEG 150 pentaerythritol tetralaurate, PEG 150 pentaerythritol tetraisostearate and PEG 150 pentaerythritol tetrastearate, the results of which are shown in FIG. 1. As evident from FIG. 1, the use of PEG 150 pentaerythritol tetrastearate is superior in thickening efficiency over PEG 150 pentaerythritol tetraisostearate, which is superior in thickening efficiency over PEG 150 pentaerythritol tetralaurate.

In view of the apparent superiority of PEG 150 pentaerythritol tetrastearate, its effectiveness as a viscosity enhancer was compared with PEG 6000 distearate in three different shampoo control formulations. The control formulations were prepared by mixing together the following components by weight percentage:

| | |
|---|---|
| CONTROL FORMULA II | |
| Miranol BT | 36.1% |
| Tween 20 | 5.2% |
| Propylene Glycol | 1.0% |
| Deionized Water | 57.7% |
| CONTROL FORMULA III | |
| Mirannol 2MCAS mod. | 35% |
| Incromide LR | 1% |
| Tween 20 | 1% |
| Propylene Glycol | 2% |
| Deionized Water | 61% |
| CONTROL FORMULA IV | |
| Miranol HM conc. | 20.4% |
| Sodium lauryl ether sulfate 3 mol (30%) | 30.6% |
| Tween 20 | 10.0% |
| Dowicil 200 | 0.1% |
| Deionized Water | 38.9% |

Miranol BT, Mirannol 2MCAS mod., Miranol HM conc. and Sodium lauryl ether sulfate 3 mol (30%) were used as the primary detergents. Miranol BT is a formulation of lauryl amphodiacetate and sodium trideceth sulfate. Miranol 2MCAS mod. is a formulation of cocoamphodiacetate, sodium lauryl sulfate, sodium laureth sulfate and propylene glycol. Miranol HM conc. is a formulation of lauro amphoacetate. Tween 20, a formulation of polysorbate 20 is a non-ionic surfactant used to reduce the skin irritation properties of Miranol BT. Propylene glycol is used as a coupling agent. Incromide LR, a formulation of lauramide DEA, is used as a foam booster. Dowicil 200, a formulation of quaternium 15, is used as a preservative.

Figure 2:
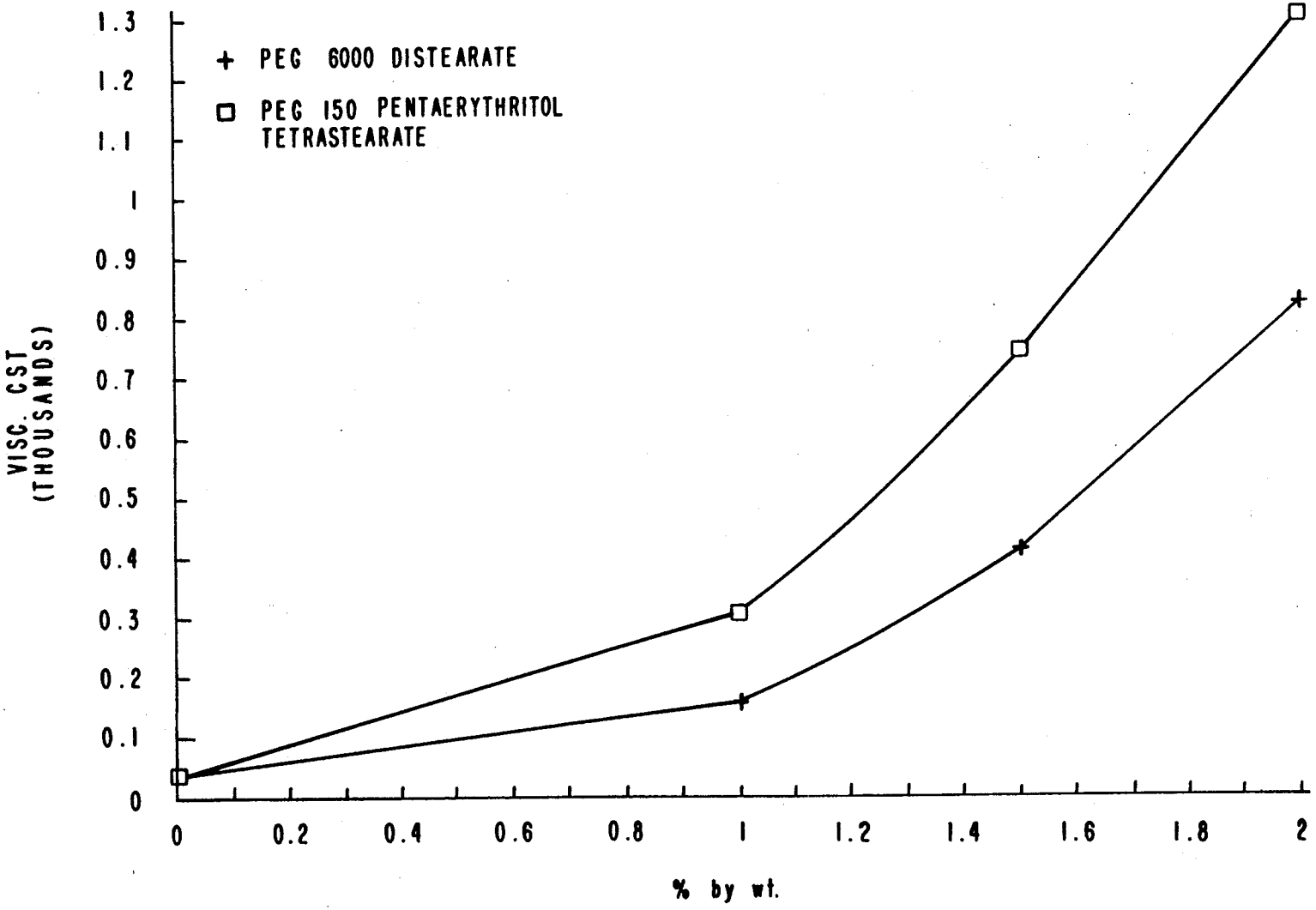
FIG. 2 is a graph illustrating the comparative effect of PEG 6000 Distearate and PEG 150 pentaerythritol tetrastearate in increasing the viscosity of a second control topical preparation.
Figure 3:
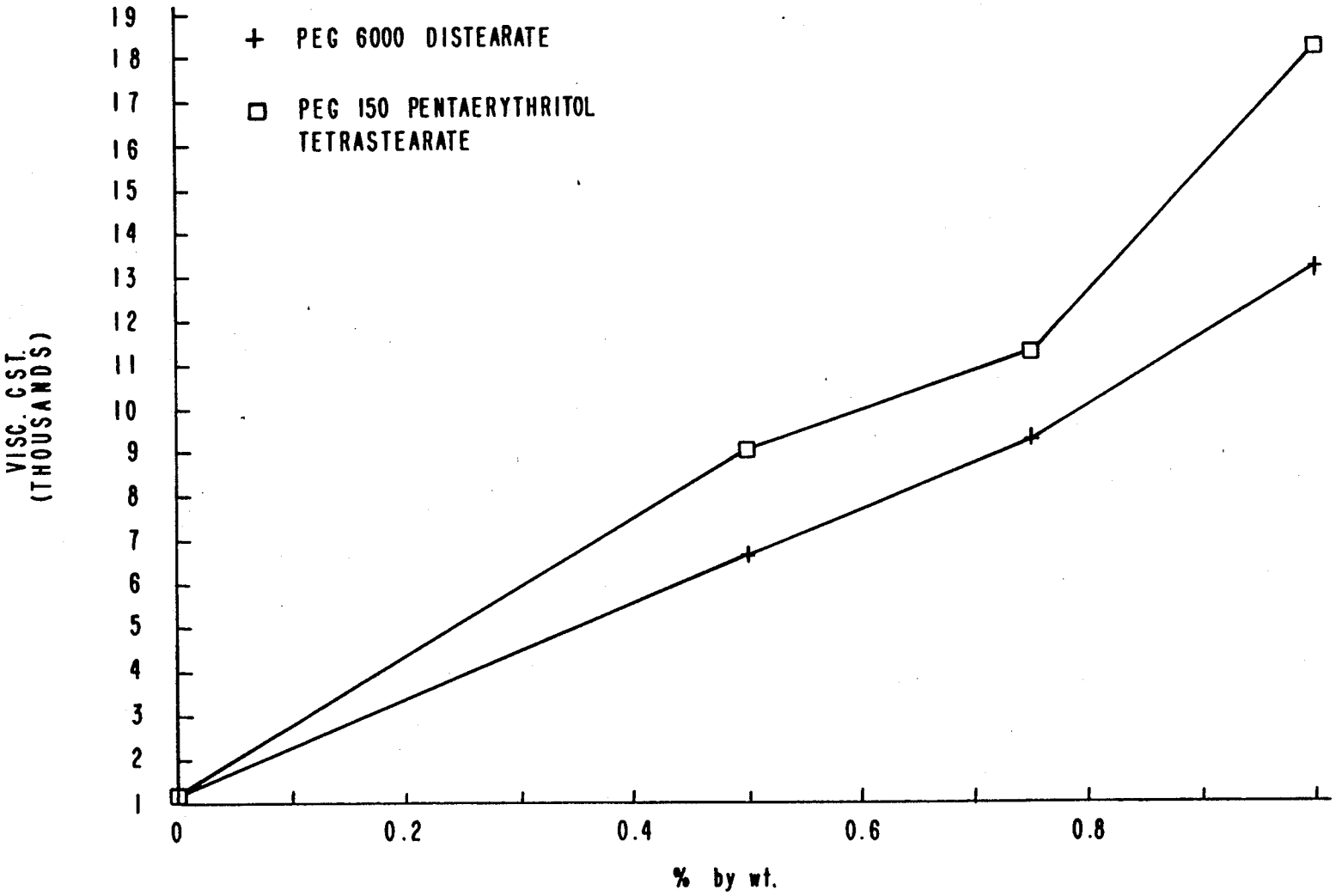
FIG. 3 is a graph illustrating the comparative effect of PEG 6000 Distearate and PEG 150 pentaerythritol tetrastearate in increasing the viscosity of a third control topical preparation.
Figure 4:
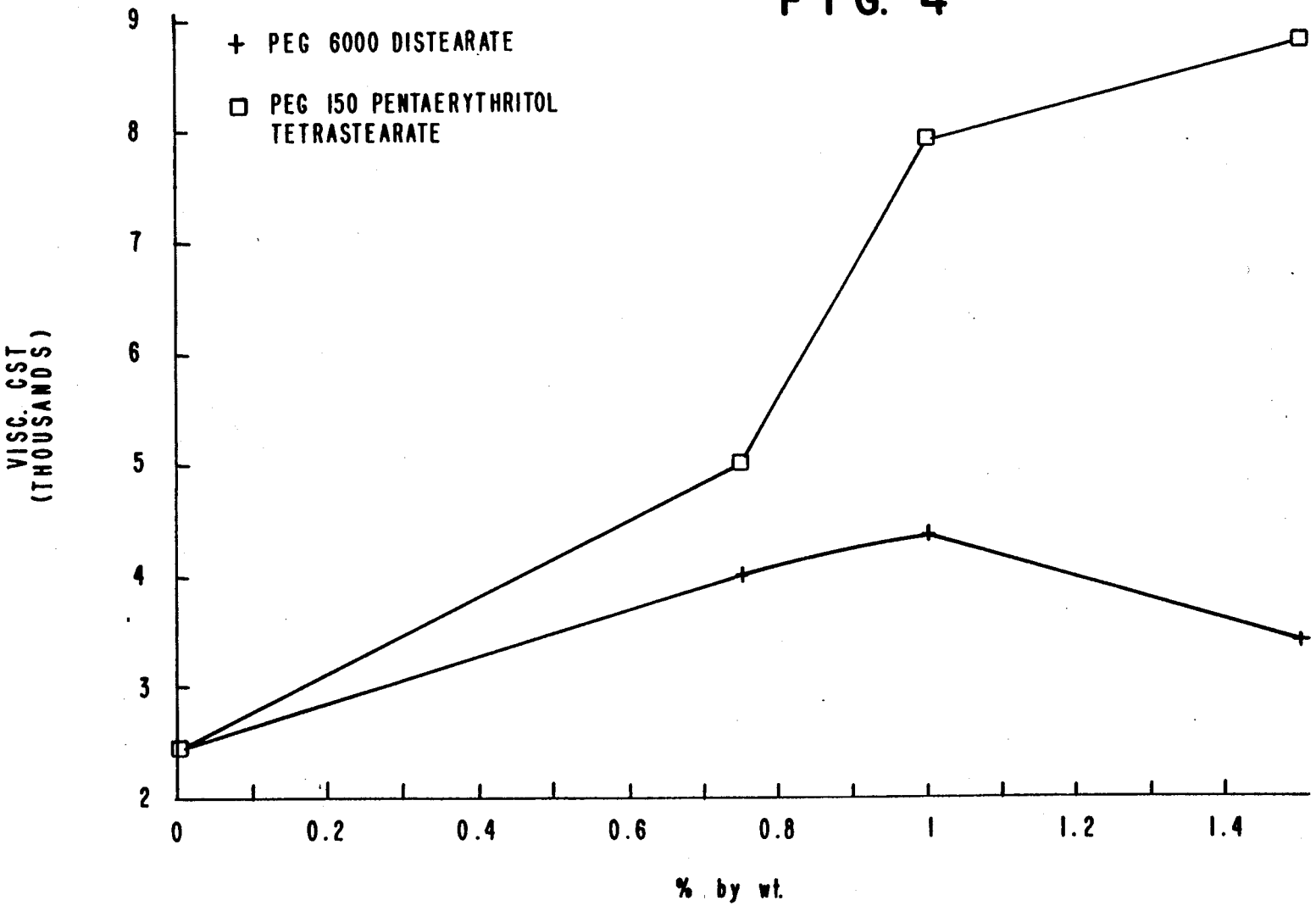
FIG. 4 is a graph illustrating the comparative effect of PEG 6000 Distearate and PEG 150 pentaerythritol tetrastearate in increasing the viscosity of a fourth control topical preparation.

Varying amounts of PEG 150 pentaerythritol tetrastearate and PEG 6000 distearate were incorporated into the control formulations II, III and IV in the manner as described above with respect to control formula I. The resulting viscosity of the shampoo formulations, measured at 25° C., are shown in FIGS. 2 through 4. In all cases, the use of PEG 150 pentaerythritol tetrastearate evidence superior thickening properties over PEG 6000 distearate.

As previously noted, the thickening agents of the present inventions have particular utility in formulating shampoo compositions. Shampoo compositions are generally known to include a thickening agent, a detergent, i.e., a surfactant, and the balance being water. The thickening agents in accordance with the present invention, for example, PEG 105 pentaerythritol dibehenate, PEG 105 pentaerythritol tetrabehenate, PEG 150 pentaerythritol tetrastearate, PEG 150 pentaerythritol tetralaurate, PEG 150 pentaerythritol tetraisostearate, PEG 130 pentaerythritol tetrastearate, and PEG 75 pentaerythritol tetrastearate are used in a range of from about 0.25 to 6% by weight of the composition, preferably 0.75 to 3% by weight of the composition, and optimally 1.5% by weight of the composition. The detergent may include a variety of surfactants of the anionic type, non-ionic type, amphoteric type and mixtures thereof. The detergents may be added in amounts of from about 3 to 25% by weight of the composition, preferably from 8 to 16% by weight of the composition, and optimally 12% by weight of the composition. Suitable anionic surfactants include sodium lauryl sulfate, sodium laureth sulfate, ammonium lauryl sulfate and triethanolamine lauryl sulfate. Non-ionic surfactants include polysorbate 20, lauramide DEA and sucrose monococoate. Amphoteric surfactants include cocoamidopropyl hydroxysultaine, lauroampho diacetate and cocamidopropyl betaine.

In addition to the main components of the shampoo composition, additional additives may be included, for example, coloring agents, fragrances, proteins, humectants, salts, preservatives, essential oils and the like. These additional components may be added in various amounts as well known in the shampoo formulation art.

The following example, while not intended to be limiting, demonstrates an additional embodiment of a detergent containing formulation in the nature of a soap bar in accordance with the present invention.

EXAMPLE 12

SOAP BAR FORMULATION:

| | (WT %) | | |
|---|---|---|---|
| | RANGE | PREFERRED | OPTIMUM |
| Sodium Stearate | 20–30 | 22–26 | 24.00 |
| Triethanolamine Lauryl Sulfate | 15–20 | 17–20 | 18.00 |
| Lactamide MEA | 5–15 | 8–10 | 10.00 |
| PPG-12-PEG-65 Lanolin Oil | 0–8 | 3–6 | 3.50 |
| Cocamido DEA Cocoyl Sarcosinate | 10–30 | 15–25 | 20.00 |
| Glycerine | 5–15 | 10–13 | 12.85 |
| Propylene Glycol | 6–10 | 7–9 | 8.00 |
| Urea | 0–4 | 1–3 | 2.00 |
| Disodium EDTA | 0–1 | .05–.20 | 0.15 |
| PEG 150 Pentaerythritol Tetrastearate | .5–5 | 1–2 | 1.50 |

As previously noted, the thickening agents of the present invention may be utilized in other than shampoo formulations, for example, cosmetics and other topical preparations. These topical preparations include the essential compounds of a thickening agent, an active ingredient and the balance being water. Suitable active agents for use in topical preparations include sunscreens, moisturizers, film formers, detergents, emulsifiers, antiseptic agents, conditioning agents, deodorant actives, reducing agents for permanent wave products and the like.

The following examples, while not intended to be limiting, demonstrate several preferred embodiments of topical preparations in accordance with the present invention.

EXAMPLE 13

CONDITIONER FORMULATION:

| | (WT %) | | |
|---|---|---|---|
| | RANGE | PREFERRED | OPTIMUM |
| Stearalkonium Chloride (conditioning agent) | .5–3 | .75–1.5 | 1% |
| Cetyl Alcohol | .4–2.5 | .75–1.2 | 1% |
| PEG 150 Pentaerythritol Tetrastearate | .2–3.5 | .5–2 | 1% |
| Water | Balance | Balance | 97% |

EXAMPLE 14

ALCOHOLIC AFTER SHAVE STICK FORMULATION:

| | (WT %) | | |
|---|---|---|---|
| | RANGE | PREFERRED | OPTIMUM |
| PPG 5 Ceteth 20 | 1–10 | 4–6 | 5.0 |
| Sodium Stearate | 1–10 | 4–6 | 5.0 |
| Silicone Fluid | 0–5 | 1–2 | 2.0 |
| Propylene Glycol | 0–6 | 4–5 | 4.0 |
| Ethanol | 60–80 | 65–75 | 71.5 |
| Water | Balance | Balance | 10.0 |
| PEG 150 Pentaerythritol Tetrastearate | 1–8 | 2–4 | 2.5 |

Although the invention herein has been described with references to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the claims.

We claim:

1. A shampoo composition comprising:

from about 3% to about 51% by weight of a detergent selected from the group consisting of anionic surfactants, non-ionic surfactants, amphoteric surfactants and mixtures thereof, water, and from about 0.25 to about 6% by weight of a polyether ester thickening agent of the formula:

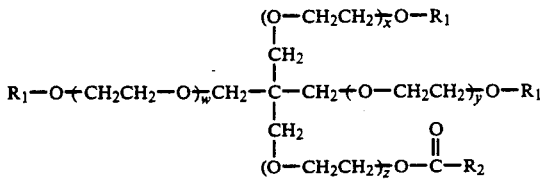

wherein:

$R_1$ is —H or

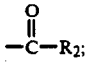

$R_2$ is a straight hydrocarbon chain having greater than 5 carbon atoms; and (W+X+Y+Z) is greater than 60.

2. The shampoo composition of claim 1, wherein said detergent is present in an amount in the range of about 8% to 16% by weight of said composition.

3. The shampoo composition of claim 1, wherein said thickening agent is present in an amount in the range of about 0.75 to 3% by weight of said composition.

4. The shampoo composition of claim 1, wherein said detergent is present in an amount of about 12% by weight of said composition and said thickening agent is present in an amount of about 1.5% by weight of said composition.

5. The shampoo composition of claim 1, wherein aid detergent is selected from the group consisting of sodium lauryl sulfate, sodium laureth sulfate, ammonium lauryl sulfate, triethanolamine lauryl sulfate, polysorbate 20, lauramide DEA, sucrose monococoate, cocoamidopropyl hydroxysultaine, lauroamphodiacetate, cocamidopropyl betaine and mixtures thereof.

6. The shampoo composition of claim 1, wherein said thickening agent is selected form the group consisting of PEG 105 pentaerythritol dibehenate, PEG 105 pentaerythritol tetrabehenate, PEG 150 pentaerythritol tetrastearate, PEG 150 pentaerythritol tetralaurate, PEG 130 pentaerythritol tetrastearate, PEG 75 pentaerythritol tetrastearate, PEG 105 pentaerythritol monobehenate, PEG 105 pentaerythritol tribehenate, PEG 150 pentaerythritol monostearate, PEG 150 pentaerythritol distearate, PEG 150 pentaerythritol tristearate, PEG 150 pentaerythritol monolaurate, PEG 150 pentaerythritol dilaurate, PEG 150 pentaerythritol trilaurate, PET 130 pentaerythritol monostearate, PEG 130 pentaerythritol distearate, PEG 130 pentaerythritol tristearate, PEG 75 pentaerythritol monostearate, PEG 75 pentaerythritol distearate, PEG 75 pentaerythritol tristearate and mixtures thereof.

7. The shampoo composition of claim 1, wherein $R_1$ is

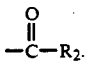

8. A composition for topical application comprising from about 3% to about 25% by weight of an active ingredient selected from the group consisting of sunscreens, moisturizers, film formers, detergents, emulsifiers, antiseptic agents, conditioning agents, deodorant actives, reducing agents for permanent wave products and mixtures thereof, water and from about 0.2 to about 8% by weight of a polyether ester thickening agent of the formula:

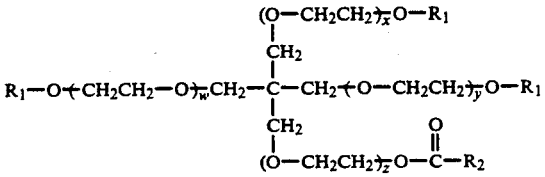

wherein:

$R_1$ is —H or

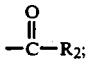

$R_2$ is a hydrocarbon chain having greater than 5 carbon atoms; and (W+X+Y+Z) is greater than 60.

9. The composition of claim 8, wherein said thickening agent is present in an amount in the range of about 0.5% to 4% by weight of said composition.

10. The composition of claim 8, wherein said thickening agent comprises PEG 150 pentaerythritol tetrastearate.

11. The composition of claim 8, wherein said thickening agent is selected from the group consisting of PEG 105 pentaerythritol dibehenate, PEG 105 pentaerythritol tetrabehenate, PEG 150 pentaerythritol tetrastearate, PEG 150 pentaerythritol tetralaurate, PEG 130 pentaerythritol tetrastearate, PEG 75 pentaerythritol tetrastearate, PEG 105 pentaerythritol monobehenate, PEG 105 pentaerythritol tribehenate, PEG 150 pentaerythritol monostearate, PEG 150 pentaerythritol distearate, PEG 150 pentaerythritol tristearate, PEG 150 pentaerythritol monolaurate, PEG 150 pentaerythritol dilaurate, PEG 150 pentaerythritol trilaurate, PEG 130 pentaerythritol monostearate, PEG 130 pentaerythritol distearate, PEG 130 pentaerythritol tristearate, PEG 75 pentaerythritol monostearate, PEG 75 pentaerythritol distearate, PEG 75 pentaerythritol tristearate and mixtures thereof.

12. The composition of claim 8, wherein $R_1$ is

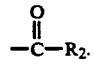

* * * * *

UNITED STATES PATENT AND TRADEMARK OFFICE

CERTIFICATE OF CORRECTION

PATENT NO. : 5,192,462

DATED : March 9, 1993

INVENTOR(S) : Gloor et al.

It is certified that error appears in the above-identified patent and that said Letters Patent is hereby corrected as shown below:

Column 3, line 4, "N-lauryl-N,carboxymethyl-N-(2-hydroxyethyl)" should read —N-lauryl-N'carboxymethyl-N-(2-hydroxyethyl)—.

Column 3, line 34, "petnaerythritol" should read —pentaerythritol—.

Column 6, line 7, "05" should read —105—.

Column 6, line 9, "50" should read —150—.

Column 7, line 7, "solution rate" should read —solution) rate—.

Column 7, line 19, "87.5" should read —687.5—.

Column 8, line 12, "and g. sodium" should read —and .1 g. sodium—.

Column 9, line 23, "36.3 g." should read —136.3 g.—.

Column 10, line 14, "tetraisostearate.and" should read —tetraisostearate and—.

Column 13, line 34, "wherein aid" should read —wherein said—.

Column 13, line 55, "PET" should read —PEG—.

Signed and Sealed this

Twenty-third Day of November, 1993

*Attest:*

Bruce Lehman

BRUCE LEHMAN

*Attesting Officer*

*Commissioner of Patents and Trademarks*